United States Patent [19]

Horton et al.

[11] 4,339,866

[45] Jul. 20, 1982

[54] METHOD OF CONNECTING A TUBE TO A FLANGE

[75] Inventors: Edward R. Horton, Dunlap; John L. Hughes, Peoria, both of Ill.

[73] Assignee: Caterpillar Tractor Co., Peoria, Ill.

[21] Appl. No.: 245,226

[22] PCT Filed: May 27, 1980

[86] PCT No.: PCT/US80/00642

§ 371 Date: May 27, 1980

§ 102(e) Date: May 27, 1980

[87] PCT Pub. No.: WO81/03443

PCT Pub. Date: Dec. 10, 1981

[51] Int. Cl.[3] ..... B21D 39/00; B23P 11/02

[52] U.S. Cl. ..... 29/523; 29/237; 29/252; 29/701; 29/788; 72/370; 285/222

[58] Field of Search ..... 29/523, 701, 237, 702, 29/243.52, 252, 703, 788, 283.5; 72/370; 285/222; 414/489

[56] References Cited

U.S. PATENT DOCUMENTS

| | | | |
|---|---|---|---|
| 1,647,447 | 11/1927 | Hartnett . | |
| 1,716,429 | 6/1929 | Davies | 29/523 |
| 2,622,652 | 12/1952 | Conroy et al. | 29/237 |
| 2,679,681 | 6/1954 | Resler . | |
| 2,871,734 | 2/1959 | Fuchs, Jr. et al. | 29/237 |
| 3,119,435 | 1/1964 | Greenman | 29/523 X |
| 3,166,828 | 1/1965 | Tupper | 29/523 X |
| 3,280,454 | 10/1966 | Rich et al. | 29/523 X |
| 3,660,884 | 5/1972 | Kowal | 29/237 |
| 3,866,457 | 2/1975 | Bagby . | |
| 3,967,840 | 6/1976 | McFall | 29/523 |
| 3,982,778 | 9/1976 | Spencer et al. . | |
| 4,043,160 | 8/1977 | Baker et al. | 29/237 X |
| 4,209,898 | 7/1980 | Aoki | 29/701 X |
| 4,289,441 | 9/1981 | Inaba et al. | 414/589 |

OTHER PUBLICATIONS

Industrial Robot–Publication No. K-259, Cincinnati Milacron, Inc. Circa 1977.

*Primary Examiner*—Charlie T. Moon

*Attorney, Agent, or Firm*—Charles E. Lanchantin, Jr.

[57] ABSTRACT

A method of connecting a tube (12) to a flange (120) is disclosed including placing the tube between first and second portions (14,16) of a holding apparatus (10), closing the portions and gripping the tube securely between the portions by operation of a first powered actuator (24), positioning a force-transmitting apparatus (20) including a punch (22) into axial alignment with the tube and flange, and forcing the punch axially into the tube and expanding the tube radially outwardly into interlocking engagement with the flange by operation of a second powered actuator (26) of the force-transmitting apparatus. The portions (14,16) are preferably pivotally closed to securely grip the tube, and the force-transmitting apparatus (20) is preferably an intergrated part of a computer controlled industrial robot (32).

5 Claims, 5 Drawing Figures

METHOD OF CONNECTING A TUBE TO A FLANGE

DESCRIPTION

1. Technical Field

This invention relates generally to a method of mechanically connecting a tube to a flange, and more particularly to an improved method of expanding the tube radially outwardly into interlocking engagement with the flange.

2. Background Art

Metal flanges having a plurality of grooves in a central bore therein have heretofore been connected to a metal tube by inserting a rotating expander assembly into the end of the tube. The rotating expander assembly has a tapered mandril and a plurality of floating tapered elongate rollers contained within an accompanying cage. The rollers are expanded by insertion of the rotating mandril and this deforms the metal of the tube radially outwardly into interlocking engagement with the flange. Such method is disclosed, for example, in U.S. Pat. No. 3,982,778 to B. G. Spencer, et al on Sept. 28, 1976.

Over the years these rotating mandril methods have been generally satisfactory. But as the tube walls have been made thicker to withstand higher operating pressures it has been increasingly difficult to make a high quality joint. For example, the amount of energy required to force the rollers into the tube bores to expand the walls has increased until surface spalling has been noted on the inside surfaces of the bores. With such spalling undesirable flakes of metal can be flushed into the associated control system as hydraulic fluid or the like is directed through the tubes. Moreover, the increased forces that have been required have resulted in increased failure and breakage of the expensive rotating expander assemblies and cracking of the flanges prior to obtaining the desired amount of fill of the grooves in the flange. Flakes of metal getting into the expander assembly can contribute to these problems.

Not only is a considerable amount of energy used, but also a substantial amount of time is required to make a satisfactory joint using the rotating mandril method.

The present invention is directed to overcoming one or more of the problems as set forth above.

DISCLOSURE OF THE INVENTION

In one aspect of the present invention a method of connecting a tube to a flange includes placing the tube between first and second portions of a holding apparatus, closing the portions and securely gripping the tube by operation of a first powered actuator, positioning a force-transmitting apparatus including a profiled punch into axial alignment with the tube, and forcing the punch into the tube and expanding it radially outwardly into interlocking engagement with the flange by operation of a second powered actuator.

In accordance with another aspect of the invention the first and second portions of the holding apparatus have semi-cylindrical recesses and are connected together such that the method includes pivotally closing the portions and gripping the tube securely in the recesses.

In the illustrated embodiment the first powered actuator is pivotally secured to the first portion of the holding apparatus in such a manner that the method can subsequently include forcibly separating the first and second portions by retracting the actuator.

In accordance with a further aspect of the invention the force-transmitting apparatus can include a computer controlled industrial robot for automatically moving the force-transmitting apparatus into a preselected position.

In the illustrated embodiment the force-transmitting apparatus has a pair of gripping arms of such a construction that the method includes closing the arms embracingly on the holding apparatus before urging the punch into the tube, and after the punch has been withdrawn from the tube opening the arms away from the holding apparatus.

Advantageously, after the tube is rigidly secured in the closed holding apparatus by actuation of the first powered actuator, the programmed industrial robot of the force-transmitting apparatus can automatically and precisely position the profiled punch into axial alignment with the tube. Thereafter the gripping arms are closed upon the holding apparatus, the punch is forced into the tube a preselected distance, the punch is retracted, and the gripping arms are opened away from the holding apparatus so that the industrial robot can be subsequently positioned at a separate work station. The result is an improved production method that can quickly and positively interlock a tube to a flange without the tube spalling noted with rotating mandril processes. Moreover, less time and energy is required, and yet the tubes are coupled more tightly to the flanges with less decrease in the wall thickness of the tubes.

BEST MODE OF CARRYING OUT THE INVENTON

Figure 1:
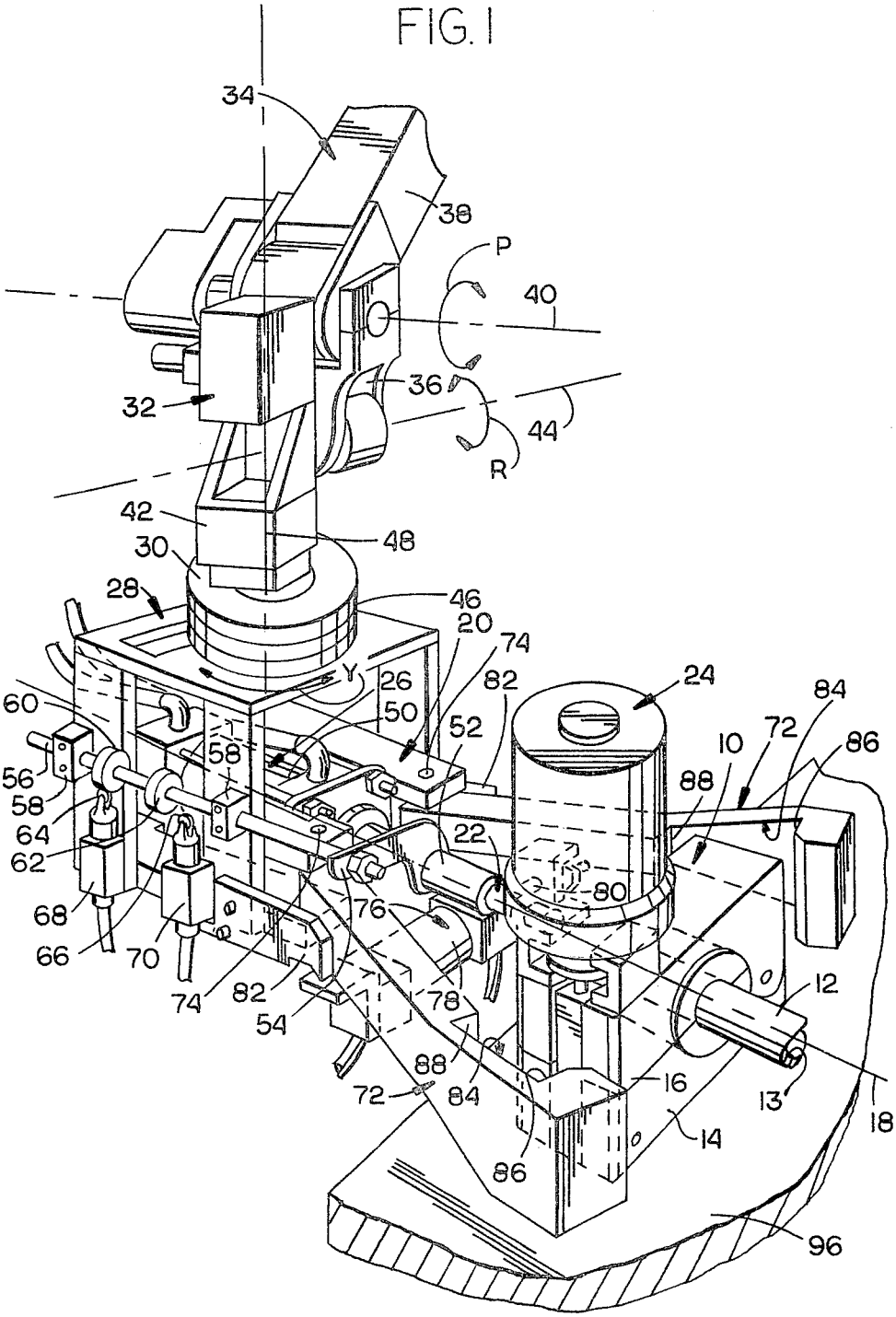
FIG. 1 is a partially fragmentary, diagrammatic, perspective elevational view of an embodiment of the present invention illustrating a tube securely held in a holding apparatus and with a force-transmitting apparatus aligned with the tube.

In the illustrated embodiment of the invention shown in FIG. 1, a holding apparatus 10 securely grips a mild steel tube 12 having an internal bore 13 between first and second portions 14,16 thereof along a main axis 18. A force-transmitting apparatus 20 includes a punch 22 of preselected external contour larger than the bore 13 which is positioned on the main axis preparatory to being urged or forced axially within the tube. The holding apparatus 10 includes a first powered actuator or telescoping hydraulic jack 24 for forcibly clamping the first and second portions 14,16 together, and the force-transmitting apparatus 20 includes a second powered actuator or telescoping hydraulic jack 26 for forcing the punch axially within the tube.

More specifically, the force-transmitting apparatus 20 includes a frame assembly 28 carried upon a distal end portion 30 of an industrial robot 32. The robot is preferably computer controlled and has a multi-segmented arm 34 that can be automatically positioned in any one of a plurality of working attitudes. For example, a second portion 36 of the arm 34 can be rotated on a first portion 38 about a horizontal first axis 40 to provide a variable degree of pitch as is illustrated by the arrow identified by the letter P in FIG. 1. A third portion 42 can be rotated on the second portion 36 about a second axis 44 to provide a variable degree of roll as is illustrated by the arrow identified by the letter R. A fourth portion 46 can be rotated on the third portion 42 about a generally upright third axis 48. Frame assembly 28 is mounted on the fourth portion 46 of the arm 34 so that it can thus be appreciated that the frame assembly can be conveniently positioned in any one of a plurality of working attitudes. The multi-segmented arm 34 of the industrial robot 32 is of conventional construction and reference is made to the commercial line of industrial robots and associated automatic control systems produced by Cincinnati Milacron, Inc. of Cincinnati, Ohio under the trademark $T^3$ Industrial Robot, the full operation of which is incorporated herein by reference.

The powered actuator 26 of the forcetransmitting apparatus 20 includes a cylindrical portion 50 releasably secured to the frame assembly 28, and an extendable rod portion 52 to which is attached the profiled punch 22. A bracket 54 extends transversely from the rod portion and a cylindrical actuating rod 56 is releasably secured to the bracket. The actuating rod is slidably mounted within a spaced pair of bearing assemblies 58 secured to the frame assembly, and first and second annular cam members 60,62 are releasably secured to the rod at preselected spaced points therealong. First and second cam-operated followers 64,66 functionally cooperate with first and second electrical limit switches 68,70 to advise the control system of the industrial robot 32, not shown, of the fully extended and fully retracted positions of the punch 22 and to stop the punch automatically thereat.

The force-transmitting apparatus 20 further includes a pair of gripping arms 72 pivotally secured to the frame assembly 28 at a corresponding pair of generally upright pivot joints 74. A third powered actuator or telescoping hydraulic jack 76 having a head end portion 78 and a rod end portion 80 pivotally connected to the individual gripping arms is actuated by the control system of the robot 32, and a pair of side bars 82 secured to the frame assembly limit the maximum opening of the gripping arms to a preselected degree. Each of the griping arm 72 has an inwardly facing recess 84 therein defining first and second thrust or reaction surfaces 86,88 as are shown more clearly in FIGS. 4 and 5.

Figure 2:
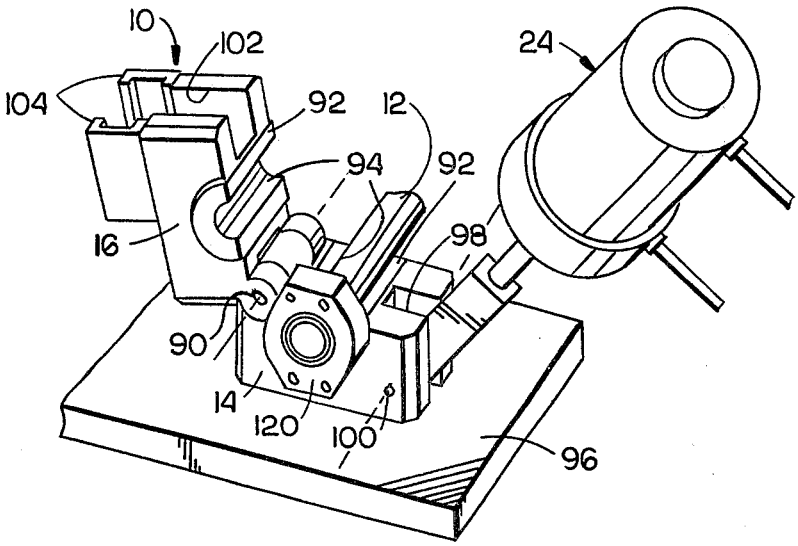
FIG. 2 is a fragmentary, diagrammatic, perspective elevational view of the tube holding apparatus of FIG. 1 showing the second portion thereof pivotally opened from the first portion.
Figure 3:
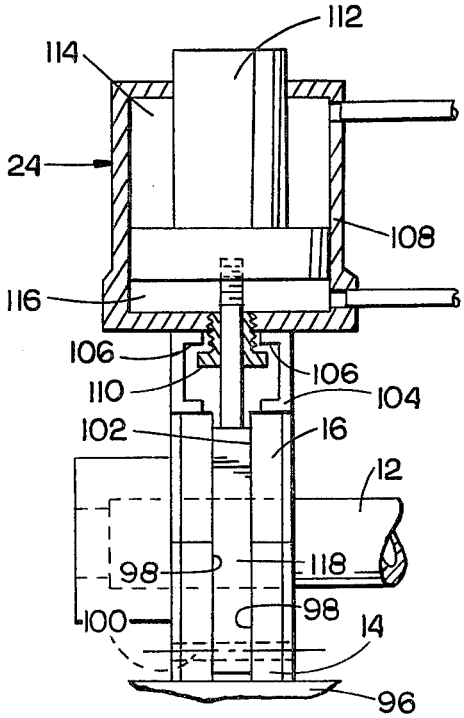
FIG. 3 is a fragmentary, diagrammatic, elevational view of the tube holding apparatus shown in FIGS. 1 and 2 with portions broken open in section to better illustrate details of construction thereof.

Turning now to the constructon of the holding apparatus 10 as best shown in FIGS. 2 and 3, the first and second portions 14,16 thereof are pivotally connected to each other by a pivot joint 90. Replaceable half bushing members 92, each having a semi-cylindrical recess 94, are releasably disposed in the respective first and second portions for accommodating tubes 12 of different diameters.

The first or lower portion 14 of the holding apparatus 10 is rigidly secured to a table or working platform 96 and has a recess 98 defined therein and a second pivot joint 100. The second or upper porton 16 has a recess 102 substantially like the lower recess 98 and alignable therewith when the upper portion is pivotally closed upon the lower portion about the pivot joint 100. As best shown in the side elevation of FIG. 3, a pair of opposed or facing C-shaped channels 104, individually defining a shoulder 106, are rigidly connected to the top of the upper portion 16.

The first powered actuator 24 includes a head end portion 108 having a device 110 screwthreadably secured thereto, and a rod end portion 112 defining with the head end portion first and second fluid chambers 114,116. The rod end portion 112 includes a depending rod 118 that is sealingly and slidably received in the device 110 and that is pivotally secured to the lower portion 14 of the holding apparatus 10 at the pivot joint 100.

Figure 4:
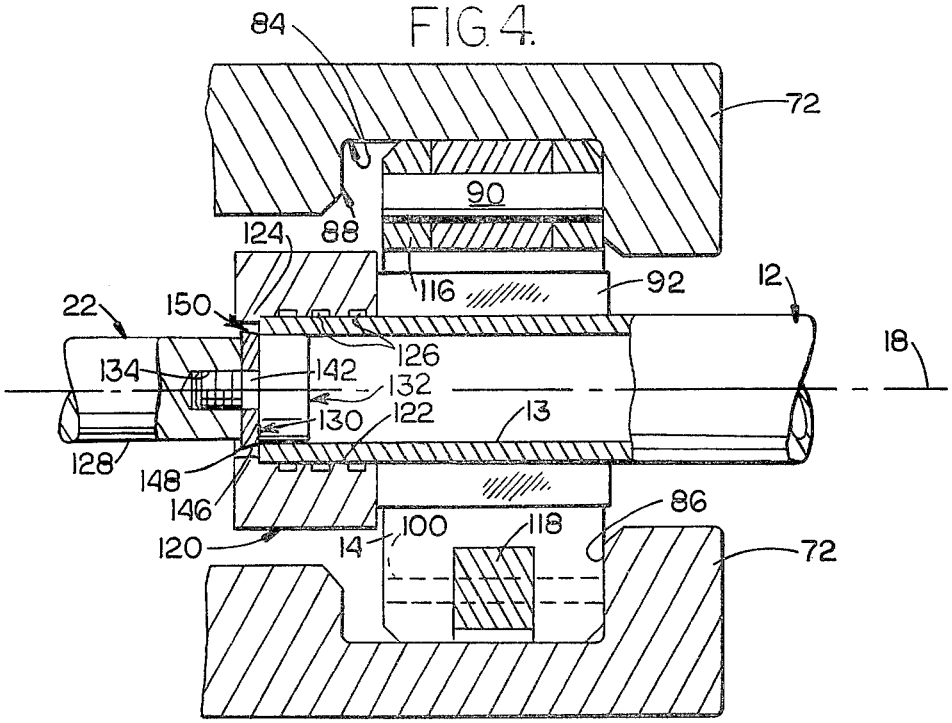
FIG. 4 is an enlarged, fragmentary, diagrammatic, horizontal sectional view of the tube holding apparatus shown in FIGS. 1–3 illustrating the distal ends of the gripping arms of the force-transmitting apparatus in embracing relation to the holding apparatus and the profiled punch in its initial position.
Figure 5:
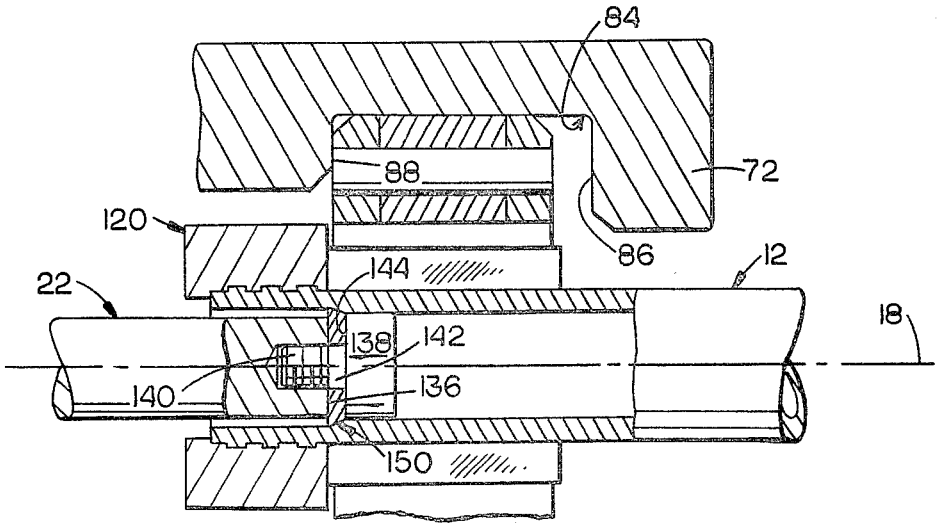
FIG. 5 is a view similar to FIG. 4 showing the profiled punch in its fully inserted position within the tube and the flange, and the gripping arms in position to absorb the thrust of the plunger upon initial retraction thereof.

As is best illustrated in FIGS. 4 and 5, a flange 120 having an internal bore 122 and a shoulder 124 is fitted over the end of the tube 12 such that the tube abuts the shoulder. The flange is preferably make of a powered metal such as alloyed iron as is, for example, described in U.S. Pat. No. 3,982,778 to B. G. Spencer, et al on Sept. 28, 1976. A plurality of annular grooves or channels 126 are formed in the flange which open inwardly on the bore and, in general, the profiled punch 22 is adapted to displace the metal of the tube 12 radially outwardly into interlocking conformance with these grooves.

Preferably, the profiled punch 22 includes a base 128, an annular insert 130 and a retaining end member 132 as is illustrated in FIGS. 4 and 5. The base has a blind threaded bore 134 an end surface 136, and the end member has a cylindrical end portion 138, a threaded shaft 140 and a cylindrical guiding portion 142 therebetween. The insert 130 is thus replaceably contained between a surface 144 on the end portion 138 and the surface 136 on the relatively tightly fitting cylindrical guiding portion 142. The insert itself is preferably made of a material selected from the group consisting of chromium plated tool steel, hafnium carbide, and powdered metal carbide. The peripheral metal forming contour of the insert is of considerable significance and we have found that a conical leading surface 146 having a preselected angle of outward divergence and a convex surface 148 tangential thereto and formed by a preselected radius revolved around the main axis 18 is preferred. Together the surfaces 146,148 form an annular forming ramp 150 specifically sized for effective expansion of the tube material for different wall thicknesses and tube diameters.

INDUSTRIAL APPLICABILITY

In operation, the tube is initially placed in the recess 94 of the lower portion 14 of the holding apparatus 10 substantially as illustrated in FIG. 2. The semi-cylindrical recesses 94 are preferably serrated and form jointly an undersized bore or interference fit to better grip the tube. As shown in FIG. 4, the flange 120 is positioned on the tube such that the shoulder 124 thereof is seated against the end of the tube. The upper portion 16 of the holding apparatus is then rotated about pivot joint 90 from the open position shown in FIG. 2 to a substantially closed position against the lower portion. This is accomplished with the first powered actuator 24 disposed in a retracted position as illustrated. Thereafter the first powered actuator is rotated upwardly about the pivot joint 100 to a position overlapping the channels 104 substantially as illustrated in FIGS. 1 and 3. Fluid under considerable pressure, for example about 7,000 kPa (1,000 psi), is subsequently directed to the lower fluid chamber 116 from a conventional source, not shown. This causes the head end portion 108 to be urged downwardly upon the channels when viewing FIG. 3 to securely grip the tube 12.

During the time period of closing the tube 12 in the holding apparatus 10 we contemplate that the force-transmitting apparatus 20 was connecting another tube to another flange 120 at a separate work station, not shown. But, with the tube securely gripped, the force-transmitting apparatus is positioned from such remote location into axial alignment with the main axis 18 as is illustrated in FIG. 1 through automatic operatiion of the computer controlled industrial robot 32. During such automatic alignment of the frame assembly 28 with the main axis it is to be understood that the first, second, third and fourth portions 38,36,42 and 46 of the multi-segmented arm 34 can experience indpendent pitch, roll and yaw movements in a known manner.

The force-transmitting apparatus 20 is thus automatically positioned on the main axis 18 with the gripping arms 72 in a fully opened position against the side bars 82 and with the recesses 84 thereof in positions of lateral alignment with the lower and upper portions 14, 16 of the holding apparatus. Also, the rod portion 52 of the second powered actuator 26 is disposed in a retracted position wherein the profiled punch 22 is juxtaposed immediately outwardly of the end of the tube 12. At this point the region intermediate the tube and the punch is preferably lubricated by a jet of lubricating fluid from a tube mounted on the force-transmitting apparatus or by any convenient means (not shown).

The industrial robot 32 is preprogrammed to subsequently initiate automatic retraction of the third powered actuator 76 and closing of the gripping arms 72 to a position wherein the lower and upper portions 14,16 are positively received within the arm recesses 84. Whereupon the second powered actuator 26 is automatically extended from the retracted position by supplying fluid under considerable pressure, for example 12,000 kPa (1,500 psi), to the head end thereof from a conventional source, not shown.

With reference to FIG. 4, the profiled punch 22 is thus forced to the right when viewing the drawing with the cylindrical end member 132 self-centeringly disposed within the tube 12. This causes the forming ramp 150 and particularly the conical leading surface 146 thereof to displace the material of the internal bore 13 of the tube radially outwardly as can be observed when comparing FIG. 4 with FIG. 5. Preferably, the internal bore 13 is diametrically expanded about 1.5 to 6.5% with the inward or rightward travel of the punch. Such preselected amount of expansion has been found to displace the material of the tube substantially fully into interlocking engagement with the annular grooves 126 in the flange 120. During the period of rightward travel of the punch it is of significance to note that a substantial portion of the reaction forces are transmitted through the gripping arms 72. Specifically, note that in FIG. 4 the reaction surfaces 86y of the gripping arms are in force-transmitting contact with the lower and upper portions 14,16 of the holding apparatus so that major forces are not transmitted to the multi-segmented arm 34 of the industrial robot 32.

Upon reaching the fully extended position of the punch 22 illustrated in FIG. 5 the second cam member 62 has traveled to the right therewith sufficiently in FIG. 1 to displace the second cam follower 66 downwardly and to trip the second limit switch 70. This automatically initiates reverse operation of the second powered actuator 26 to retract the punch axially outwardly of the tube 12. With such reverse operation the opposite reaction surfaces 88 of the griping arms are desirably placed in force-transmitting contact with the lower and upper portions 14,16 of the holding apparatus 10 such that the forces are again substantially absorbed into the table or working platform 96.

The retraction of the second powered actuator 26 continues until the first cam member 60 contacts the first cam follower 64 sufficiently to displace it downwardly and to actuate the first limit switch 68, whereupon the actuator travel stops and the fully retracted position of the punch 22 is realized. At this point the third powered actuator 76 is automatically extended to open the gripping arms 72 away from the holding apparatus 10. The gripping arms separate until they contact the side bars 82 of the frame assembly 28.

The preprogrammed industrial robot 32 then automatically travels away from the platform 96 to a separate work station where another tube and flange connection can be similarly made.

Pressurized fluid can then be directed to the upper fluid chamber 114 of the first powered actuator 24 shown in FIG. 3. This causes the head end portion 108 to travel upwardly on the rod end portion 112 when viewing the drawing. Accordingly, the annular device 110 travels upwardly also to contact the shoulder 106 of the channels 104 and to cause the upper portion 16 of the holding apparatus 10 to pivotally open away from the lower portion 14. Since there are very large forces involved in securely clamping the tube 12, there is a considerable force resisting the subsequent separation of the lower and upper portions. But the contacting of the adjustable device 110 with the channels effectively opens the portions whereupon the fluid pressure can be released to the first powered actuator, allowing it to be rotated from an upright position to the lowered or retracted position shown in FIG. 2. Then the upper portion can be easily fully opened and the fully coupled tube and flange removed from the holding apparatus 10.

Thus it can be appreciated that the holding apparatus 10 and force-transmitting apparatus 20 of the present invention are adapted to more positively connect a flange to a tube, and with a marked savings in time and energy. Moreover, we have found that the wall thickness of the tube within the flange after deformation can be greater than with the prior method of utilizing a rotating mandril. Furthermore, the enlarged bore of the tube is smoother, and yet the flange is more tightly interlocked with the tube than with prior methods.

Other aspects, objects and advantages of this invention can be obtained from a study of the drawings, the disclosure and the appended claims.

What is claimed is:

1. A method of connecting a tube (12) to a flange (120), comprising:

Step (a) placing tube (12) with the flange (120) on the end thereof between first and second portions (14,16) of a holding apparatus (10);

Step (b) closing one of the portions (14,16) of the holding apparatus (10) and gripping the tube (12) securely between the portions (14,16) by operation of a first powered actuator (24);

Step (c) positioning a force-transmitting apparatus (20) including a punch (22) of preselected external contour into axial alignment with the tube (12) and the flange (120);

Step (d) closing a pair of gripping arms (72) of the force-transmitting apparatus (20) embracingly on the holding apparatus (10) by operation of a third powered actuator (76); and Step (e) forcing the punch (22) axially into the tube (12) and expanding the tube (12) radially outwardly into interlocking engagement with the flange (120) by operation of a second powered actuator (26) of the force-transmitting apparatus (20).

2. The method of claim 1 including Step (f) retracting the punch (22) axially outwardly of the tube 812) by reverse operation of the second powered actuator (26).

3. The method of claim 2 including Step (g) subsequently opening the pair of gripping arms (72) away from the holding apparatus (10) by reverse operation of the third powered actuator (76).

4. The method of claim 3 including Step (h) moving the force-transmitting apparatus (20) away from the holding apparatus (10).

5. The method of claim 4 wherein Steps (c) through (h) are achieved automatically by computer controlled programming of an industrial robot (32) and the force-transmitting apparatus (20).

* * * * *